US007494699B2

(12) United States Patent
Sasaki

(10) Patent No.: US 7,494,699 B2
(45) Date of Patent: Feb. 24, 2009

(54) LOW ENERGY THERMAL TRANSFER RECORDING MEDIUM AND METHOD

(75) Inventor: Takayuki Sasaki, Mishima (JP)

(73) Assignee: Ricoh Company Limited, Tokyo (JP)

( * ) Notice: Subject to any disclaimer, the term of this patent is extended or adjusted under 35 U.S.C. 154(b) by 313 days.

(21) Appl. No.: 11/214,728

(22) Filed: Aug. 31, 2005

(65) Prior Publication Data

US 2006/0057311 A1 Mar. 16, 2006

(30) Foreign Application Priority Data

Sep. 13, 2004 (JP) ..... 2004-265816

(51) Int. Cl.
*B41M 5/26* (2006.01)

(52) U.S. Cl. ..... 428/32.82; 156/235; 428/32.84

(58) Field of Classification Search ..... None
See application file for complete search history.

(56) References Cited

U.S. PATENT DOCUMENTS 4,783,375 A * 11/1988 Hashimoto et al. ..... 428/32.87
6,787,203 B2 9/2004 Hiroishi et al.

FOREIGN PATENT DOCUMENTS

| | | |
|---|---|---|
| EP | 0 339 353 A2 | 11/1989 |
| EP | 1 285 776 A1 | 2/2003 |
| EP | 1 293 355 A1 | 3/2003 |

* cited by examiner

*Primary Examiner*—Bruce H Hess
(74) *Attorney, Agent, or Firm*—Oblon, Spivak, McClelland, Maier & Neustadt, P.C.

(57) ABSTRACT

Thermal-transfer recording medium comprises a substrate, a releasing layer that overlies the substrate and mainly includes wax, and an ink layer that overlies the releasing layer and includes coloring agent and saturated polyester resin. The saturated polyester resin is formed by combining at least a trivalent acidic component. Number average molecular weight of the saturated polyester resin ranges from greater or equal to 300 to not greater than 1000.

11 Claims, 1 Drawing Sheet

| | HEAT SENSITIVITY SCALE | 6pt CHINESE CHARACTER | 6pt NUMERIC CHARACTER | HORIZONTAL RULED LINE | IMAGE RIGIDITY (NUMBER OF TIMES) |
|---|---|---|---|---|---|
| EXAMPLE 1 | +8 | O | O | O | 40 |
| EXAMPLE 2 | +10 | O | O | O | 40 |
| EXAMPLE 3 | +10 | O | O | O | 70 |
| EXAMPLE 4 | +12 | O | O | O | 160 |
| EXAMPLE 5 | +6 | O | O | O | 100 |
| EXAMPLE 6 | +8 | O | O | O | 180 |
| COMPARATIVE EXAMPLE 1 | +10 | × | O | × | 5 |
| COMPARATIVE EXAMPLE 2 | +22 | O | × | O | 20 |

FIGURE

| | HEAT SENSITIVITY SCALE | 6pt CHINESE CHARACTER | 6pt NUMERIC CHARACTER | HORIZONTAL RULED LINE | IMAGE RIGIDITY (NUMBER OF TIMES) |
|---|---|---|---|---|---|
| EXAMPLE 1 | +8 | O | O | O | 40 |
| EXAMPLE 2 | +10 | O | O | O | 40 |
| EXAMPLE 3 | +10 | O | O | O | 70 |
| EXAMPLE 4 | +12 | O | O | O | 160 |
| EXAMPLE 5 | +6 | O | O | O | 100 |
| EXAMPLE 6 | +8 | O | O | O | 180 |
| COMPARATIVE EXAMPLE 1 | +10 | × | O | × | 5 |
| COMPARATIVE EXAMPLE 2 | +22 | O | × | O | 20 |

LOW ENERGY THERMAL TRANSFER RECORDING MEDIUM AND METHOD

CROSS REFERRENCE TO RELATED APPLICATION

This application claims priority under 35 USC § 119 to Japanese Patent Application No. 2004-265816 filed on Sep. 13, 2004, entire contents of which are herein incorporated by reference.

COPYRIGHT NOTICE

A portion of the disclosure of this patent document contains material, which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

1. Field of the Invention

The present invention relates to a thermal-transfer recording medium and a method using the thermal-transfer recording medium.

2. Discussion of the Background Art

When an image of a logistics label or a rated label and the like is formed on a transferring objective, such as a sheet, a film, etc., using a thermal-transfer method, for example, by transferring an ink from a thermal-transfer sheet, a certain printing energy is generally needed. A necessary amount of the printing energy varies depending upon density of an image, and a type and material of a transferring objective. When a surface of a sheet is rough and printing energy is insufficient, an image sometimes partially drops and decreases density. When a considerable amount of printing energy is applied, a thermal head of the thermal-transfer printer becomes significantly short life, and power is wasted even admitting successful transfer onto the rough surface. Further, there are certain demands for printing of considerable information on a limited area, recently. To meet such demands, small character and graphic should be precisely reproduced. However, when the printing energy is excessively applied, these character and graphic become thick and unreadable. Further, since a label attached to logistics and a nameplate or the like should bear friction, heat, and chemicals, an image thereof should have certain rigidity. However, a conventional thermal-transfer recording medium can neither form a fine image with small printing energy nor maintain rigidity of an image.

According to a widely spreading technology, sensitive printing is enabled by including wax in an ink layer as a main component and melting the wax with low energy. However, an image has poor image rigidity, such as abrasion proof, heat resistance, chemical resistance, etc. In contrast, a thermal-transfer sheet having an ink layer mainly including resin has excellent image rigidity. However, the thermal-transfer sheet cannot melt with low energy, thereby resulting in poor heat sensitivity.

Further, it is known that a thermal-transfer sheet mainly including resin employs polyether resin, such as a PET film, having an excellent transfer performance as a label.

For example, Japanese Patent Application Laid Open No. 10-95172 discusses a technology using polyether resin. The polyether resin has a monomer composition with a sulfonate-metallic base, a glass transition point of from 4 to 80 degree centigrade, and number average molecular weight of from 5000 to 25000. Japanese Patent Application Laid Open No. 10-230682 also discusses a technology using polyether resin. The polyether resin has ethylene oxide adduct of bisphenol-A as a monomer. Further, Japanese Patent Application Laid Open No. 2003-89276 discusses a technology using polyether resin. The polyether resin has a glass transition point (Tg) of from 50 to 100 degree centigrade, and number average molecular weight of from 1000 to 10000. Japanese Patent Application Laid Open No. 2003-103946 discusses a technology using more than two types of polyether resins having different number average molecular weights. Further, as discussed in Japanese Patent Application Laid Open No. 2001-171233, it is known that solubility, i.e., a performance of solving into solvent, is specified so as to significantly improve chemical resistance.

However, a thermal-transfer sheet mainly including the above-mentioned resin improve rigidity in a sense, but is still inferior in heat sensitivity in comparison with that mainly including wax. Then, molecular weight is significantly decreased as discussed in Japanese Patent Application Publication No. 4-34957, and such a technology has an excellent transferring performance with low energy, because molecular weight is decreased and solubility is preferable. However, such a technology tends to create thermal diffusion, and thus thin line, character, and graphic cannot precisely be reproduced. In short, it is difficult to validate all of heat sensitivity, image reproducibility, and image rigidity.

SUMMARY OF THE INVENTION

Accordingly, an object of the present invention is to address and resolve such and other problems and provide a new and novel thermal transfer recording medium and a method capable of transferring a thermal-transfer medium with low energy and obtaining an image having excellent reproducibility and rigidity by using a thermal-transfer printer.

In one embodiment, a thermal-transfer recording medium includes a substrate, a releasing layer overlying the substrate and mainly including wax, and an ink layer overlying the releasing layer and including coloring agent and saturated polyester resin. The saturated polyester resin is formed by combining at least trivalent acidic component. Number average molecular weight of the saturated polyester resin ranges from greater or equal to 300 to not greater than 1000.

In another embodiment, the ink layer includes lubricant having one of polyolefin wax and oxidized polyolefin wax.

In yet another embodiment, a releasing layer includes polyolefin wax.

In yet another embodiment, a glass transition point of the saturated polyester resin ranges from greater or equal to 10 to not greater than 50 degree centigrade.

In yet another embodiment, a printer having a line type thermal head transfers the thermal transfer recording medium onto a transferring objective.

In yet another embodiment, the line type thermal head includes an end face head.

In yet another embodiment, the transferring objective includes one of a film and a paper.

BRIEF DESCRIPTION OF DRAWINGS

A more complete appreciation of the present invention and many of the attendant advantages thereof will be readily obtained as the same becomes better understood by reference to the following detailed description when considered in connection with the accompanying drawings, wherein:

FIG. 1 illustrates a table showing image sensitivity and rigidity according to experience.

PREFERRED EMBODIMENTS OF THE PRESENT INVENTION

An exemplary substrate is initially described. A thermal-transfer recording medium used in one embodiment of the present invention can employ, but is not limited to, a known substrate including material, such as polyester, polycarbonate, polyimide, polyamide, polystyrene, polysulfone, polypropylene, polyethylene, cellulose acetate, etc., or a film laminating these having a thickness of from about 3 to about 10 micrometer.

An exemplary releasing layer is now described. A thermal-transfer recording medium according to one embodiment of the present invention includes a releasing layer having wax as a main component, which is laminated overlying the above-mentioned substrate. The releasing layer improves a releasing performance to release a thermal transfer layer from the substrate during a printing process. The releasing layer melts into a low viscosity liquid when heated by the thermal head, and is readily cut in the vicinity of a boundary face between a heat applying section and a heat-applying objective. Further, the releasing layer can serve as a barrier for the thermal transfer layer after an image is formed, and bears a physical impact, such as smear, wash, etc. As heat melting wax of a releasing layer, known natural wax, such as bees wax, whale wax, Japan wax, rice wax, carnauba wax, candelilla wax, montan wax, shellac wax, etc., and known synthetic wax, such as paraffin wax, microcrystalline wax, ester wax, polyethylene wax, oxidized paraffin wax, oxidized polyethylene wax, ozokerite, ceresin, alpha-olefin derivative, etc., are utilized. In order to improve a releasing performance and a transferring performance when heat is applied, polyolefin wax, especially, polyethylene wax is used among those waxes.

Small amount of resin can be added to the releasing layer as a low viscosity performance-promoting agent so as to avoid a drop and improve a layer coating performance. Thus, ethylene-vinyl acetate copolymer or ethylene-ethyl acrylate copolymer or the like can be added.

In order to improve adhesion of a thermal-transfer recording medium to a transferring objective, butadiene rubber, ethylene-propylene rubber, butyl rubber, nitrile rubber, and styrene-butadiene rubber, and known thermoplastic or the like can be added to provide elasticity to a releasing layer. These additives are most preferably included by from about 0% to about 20% of the whole weight of the releasing layer not to interfere melting and releasing performances of the wax.

When synthetic wax such as polyolefine forms the releasing layer, a releasing layer coating liquid is made by dispersing wax into organic solvent, and then drying the dispersing result at temperature higher than a melt starting point of the wax by 5 degree centigrade and a melting point thereof by 10 degree centigrade. Specifically, the wax is partially melted (i.e., in a low molecular weight portion), and a high molecular weight portion becomes particle state. Thus, an ink layer can be uniformly formed having an excellent coating performance. When the dispersing result is dried at temperature higher than the melting point by about more than 10 degree centigrade, a melting value of the wax increases. As a result, the ink coat layer cannot be uniformly formed thereon. A thickness of the releasing layer is preferable as thinner as possible in view of heat conductivity. However, since releasing and barrier performances disappear when being too thin, an adhering value preferably ranges from about 0.1 $g/m^2$ to about 3.0 $g/m^2$, especially, from about 1.2 $g/m^2$ to about 2.0 $g/m^2$.

Now, an exemplary ink layer is described. First, coloring agent is described. A thermal-transfer recording medium according to one embodiment of the present invention is formed by laminating an ink layer overlying the above-mentioned releasing layer. The ink layer can employ, but is not limited to, conventional inorganic and organic colorants, such as carbon black, azo colorant, phthalocyanine, quinacridone, anthraquinone, perylene, chinophthalon, aniline black, titanium oxide, zinc oxide, chrome oxide, etc., as a coloring agent. Among these, carbon black is most preferably used.

Saturated polyester resin is now described. As a main component of the ink layer used in one embodiment of the present invention, saturated polyester resin is utilized and serves as a carrying member for the above-mentioned coloring agent. The saturated polyester resin includes chemical compound obtained by polycondensation reaction of an acidic component, such as polycarboxylic acid, etc., and a polyhydric alcohol component. For the above-mentioned acidic component, it is characterized in one embodiment of the present invention that aliphatic carboxylic acid, such as adipic acid, sebacic acid, succinate oxide, azelaic acid, dodecanedioic acid, etc., alicyclic carboxylic acid, such as cyclohexane dicarboxylic acid, decahydronaphthalene dicarboxylic acid, etc., trivalent carbonic acid of aromatic carboxylic acid, such as terephthalic acid, isophthalic acid, orthophthalic acid, hexahydrophthalic acid, and maleic acid, trivalent carboxylic acid such as trimellitic acid, and tetravalent carboxylic acid such as pyromellitic acid are included. When a tri- or more basic acidic component is included, a resin having a branched structure can be formed, and reproducibility of an image can be improved while maintaining excellent heat sensitivity.

As an alcohol component, ethylene glycol, neopentyl glycol, butylene glycol, propylene glycol, 1,5 pentane diol, 1,6 hexane diol, ortho-xylene glycol, para-xylene glycol, 1,4 phenylene glycol, bisphenol-A, and ethylene oxide adducts of these are included.

The saturated polyester resin according to one embodiment of the present invention can include homopolymer and copolymer obtained by polymerizing a kind of carboxylic acid and glycol, or plural kinds of carboxylic acids and glycols. Further, molecules of these homopolymer and copolymer can partially or entirely be bridged, or are not bridged. For the glycol component, ethylene glycol or neopentyl glycol is preferably used. When a short-chain glycol component, such as ethylene glycol, etc., is mainly used, aggregation of layers can be condensed. Thereby, abrasion proof and chemical resistance can be more improved. The carboxylic acidic component can be substituted by a polar group, such as sulfonate acid, etc.

A method of manufacturing saturated polyester resin can use, but is not limited to, known dehydration condensation reaction.

The saturated polyester resin preferably has number average molecular weight of from 300 to less than 1000 in view of doubling heat sensitivity and image reproducibility. Specifically, when molecular weight is less than 300 and an acidic component more than three functions is included, it is difficult to synthesize. When it is greater or equal to 1000, heat sensitivity decreases. In order to provide rigidity to an image, high-molecular weight resin is utilized. However, the higher the molecular weight of the resin, the worse the heat sensitivity. Thus, a glass transition point of polyester resin synthesized as mentioned above preferably ranges from about 10 to 50 degree centigrade, more preferably, from about 30 to 50 degree centigrade. As a result, a preferable performance of a thermal-transfer recording medium can be obtained. Specifically, when the glass transition point is not greater than 10 degree centigrade, pasting i.e., blocking, tends to occur during preservation. When it is greater or equal to 50 degree centigrade, heat sensitivity tends to decrease.

As exemplary resins other than the polyester resin, acrylic resin, polyurethane resin, epoxy resin, phenol resin, ketone resin, ionomer resin are exemplified.

Other exemplary materials are now described. The ink layer including coloring agent and polyester resin can employ lubricant so as to improve image reproducibility and rigidity. As lubricant, silicic chemical compound, such as silicone oil, silica, organo-poly-siloxane, etc., known natural wax, such as bees wax, whale wax, Japan wax, rice wax, carnauba wax, candelilla wax, montan wax, shellac wax, etc., and known synthetic wax, such as paraffin wax, microcrystalline wax, ester wax, polyethylene wax, oxidized paraffin wax, oxidized polyethylene wax, ozokerite, ceresin, alpha-olefin derivative, etc., are utilized. Also utilized is higher fatty acid, aliphatic ester, and aliphatic amide or the like. Among those, polyolefin wax or oxidized polyolefin wax can be added most preferably so as to improve image rigidity. Because, such polyolefin wax or oxidized polyolefin wax is hardly damaged by either heat or solvent.

Further, to more improve chemical resistance against solvent, such as gasoline, etc., various known resins can be added to the thermal transfer layer as a second component. Such resin preferably has an excellent quality such as abrasion proof, chemical resistance, etc. However, since it sometimes lacks an amount of heat when applied by a conventional thermal-transfer printer, the addition preferably amounts to a prescribed value not to spoil sensitivity. For example, a preferable amount of the resin can range from about 10 to 20 weight % in relation to the thermal transfer layer.

Further, to improve sensitivity and a diffusion performance of an ink layer, as well as to avoid the ink layer from dropping from the substrate, various substances such as surface-active agent, etc., can be added within the thermal transfer layer. However, the addition preferably ranges within a prescribed level not to decrease heat sensitivity and durability. The above-mentioned material that forms a thermal transfer layer is made by diffusing and melting in appropriate solvent. Preferably, the addition can be made in a layer state by coating and drying a dissolved coating liquid on a substrate using a conventional coating manner, such as a hot melt coating, a water coating, a gravure coating, a wire bar coating, a role coating, each using organic solvent, etc.

An exemplary intermediate layer is now described. In order to provide a further barrier performance, an intermediate layer including known resin can be arranged between a releasing layer and an ink layer. However, when the intermediate layer is given, since the whole thickness of an ink plane increases, the thickness of the ink layer preferably ranges within in a prescribed level not to disturb the thermal head that applies heat to the ink layer.

An exemplary backside surface layer is now described. A thermal-transfer recording medium of one embodiment of the present invention can include a backside surface layer on the opposite side of the substrate in relation to the above-mentioned respective layers (i.e., an opposite surface of the substrate to the ink layer surface). Some heat is applied to the backside surface by a thermal head in accordance with an image when the image is transferred. As a backside surface layer, material (i.e., a heat resistance protection layer) having resistance against heat, and that (i.e., a lubricant protection layer) against abrasion caused by the thermal head or the like can be used. Further, since the opposite side of the substrate partially melts with heat and adheres to the thermal head, a transferred image is damaged or conveyance of the thermal-transfer recording medium is interfered (i.e., a sticking phenomenon). Then, a layer (i.e., a stick prevention layer) can be employed to suppress these phenomena.

Such a backside layer (i.e., a heat resistance protection layer, a lubricant protection layer, a stick prevention layer) is thin and includes heat resistant polymer molecule. The backside layer can double more than two functions. Preferable polymer for the above-mentioned backside layer includes cellulose resin, silicon resin, acrylic resin, epoxy resin, melamine resin, phenol resin, fluororesin, polyimide, aromatic polyamide, polyurethane, aromatic polysulfonate, and acetoacetyl-group containing polyvinyl alcohol or the like. Beside that, inorganic fine particle, such as talic, silica, organo-polysiloxane, and the above-mentioned lubricant can be added.

An exemplary thermal-transfer recording medium of one embodiment of the present invention is now described. A transfer layer of the thermal-transfer sheet made in this manner is then heated by a hot stamp, a heat roll, a laser irradiation transferring process, a serial thermal head, a line thermal head, etc., and is transferred onto a transferring objective. The transferring manner using the line thermal head is the most preferable, because it consumes less energy while maintaining sharpness of an image. As a line thermal head, a plane head type having a head on the surface (i.e., a flat head), an end face head type having a head on the corner (i.e., a corner head) and a pseudo-end face head type having a head at the end of the surface (i.e., a near edge head) are employable. In particular, the plane head type is preferably utilized. Itis expected that the end face head type becomes mainstream from now on, because the end face head type can form an image on a thick transferring objective, such as a card, etc., at high speed. A thermal-transfer sheet of one embodiment of the present invention allows these plane head and end face head types to print.

An exemplary transferring objective is now described. As a transferring objective according to one embodiment of the present invention, a conventional film, such as a polyester film, a polyolefin film, a polyamide film, a polystyrene film, etc., a synthetic paper, a conventional paper, such as a light coat paper, a cast coat paper, an art paper, etc., and a conventional card, such as a PVC/PET having a certain thickness, are used. Among those, the polyester film, the polyolefin film, the synthetic paper, and the cast coat paper are especially preferably used.

EXAMPLES

Hereinafter, various examples of the above-mentioned layers are described more in detail, wherein a part-number represents a weight ratio of material.

First Example is now Described.

Initially, a releasing layer coating liquid having the below described composition was coated overlying a polyester film (i.e., a substrate) having thickness of 4,5 micrometer, and was dried for ten seconds at temperature of about 50 degree centigrade. As a result, a releasing layer having a weight of 0,9 g/m$^2$ on a dry basis was prepared. An ink layer use coating liquid having the below described composite was coated overlying the releasing layer, and was dried for ten seconds at temperature of about 60 degree centigrade. As a result, an ink layer having about 1,5 g/m$^2$ on a dray basis was prepared. Then, a 5% toluene solution of a silicone-modified acrylic resin is coated overlying the opposite surface of the substrate that carries the ink layer, and is dried for ten seconds at temperature of about 90 degree centigrade, so that a backside layer having about 0,2 g/m on a dry basis was prepared, thereby a thermal-transfer recording medium is produced.

Composition of a releasing layer use coating liquid:
Carnauba wax: nine parts
Ethylene-vinyl acetate copolymer: one part
Toluene: 90 parts
Composition of ink layer use coating liquid:
Carbon black: 5 parts
Saturated polyester resin (A): 15 parts
Methyl ethyl ketone (MEK): 80 parts The above-described reference sign (A) represents resin prepared by using terephthalic acid, isophthalic acid, and trimellitic acid as acidic components, and ethylene glycol and neopenthyl glycol as alcohol components. Number average molecular weight of the resin is 700, and its glass transition point (i.e., Tg) is about 15 degree centigrade.

Second Example is now Described.

A releasing layer and a backside layer are formed in the same manner as the first example. An ink layer use coating liquid having the below described composition is coated overlying the releasing layer in the same manner as the first example.

Composition of ink layer use coating liquid:
Carbon black: 5 parts
Saturated polyester resin (B): 15 parts
Methyl ethyl ketone (MEK): 80 parts The above-described reference sign (B) represents resin having terephthalic acid, isophthalic acid, and trimellitic acid as acidic components, and ethylene glycol and neopenthyl glycol as alcohol components. Further, number average molecular weight of the resin is 950, and its Tg is about 20 degree centigrade.

Third Example is now Described.

A releasing layer and a backside layer are formed in the same manner as the first example. An ink layer use coating liquid having the below described composition is coated overlying the releasing layer in the same manner as the first example.

Composition of ink layer use coating liquid:
Carbon black: 5 parts
Saturated polyester resin (B): 12 parts
Montanic Acid wax: 3 parts
Methyl Ethyl Ketone (MEK): 80 parts The above-described reference sign (B) represents resin having terephthalic acid, isophthalic acid, and trimellitic acid as acidic components, and ethylene glycol and neopenthyl glycol as alcohol components. Further, number average molecular weight of the resin is 950, and its Tg is about 20 degree centigrade.

Fourth Example is now Described.

A releasing layer and a backside layer are formed in the same manner as the first example. An ink layer use coating liquid having the below described composition is coated overlying the releasing layer in the same manner as in the first example.

Composition of ink layer use coating liquid:
Carbon black: 5 parts
Saturated polyester resin (B): 12 parts
Polyethylene wax: 3 parts
Methyl Ethyl Ketone (MEK): 80 parts The above-described reference sign (B) represents resin having terephthalic acid, isophthalic acid, and trimellitic acid as acidic components, and ethylene glycol and neopenthyl glycol as alcohol components. Further, number average molecular weight of the resin is 950, and its Tg is about 20 degree centigrade.

Fifth Example is now Described.

A releasing layer and a backside layer are formed in the same manner as the first example. A releasing layer use coating liquid having the below described composition is coated overlying the opposite-side surface, and is dried for 10 seconds at temperature of about 80 degree centigrade to prepare a releasing layer having about 0.9 g/m$^2$ on a dry basis. An ink layer use coating liquid having the below described composition is coated overlying the releasing layer in the same manner as in the first example.

Composition of a releasing layer use coating liquid:
Polyethylene wax: 9 parts
Ethylene-vinyl acetate copolymer resin: 1 part
Toluene: 90 parts
Composition of ink layer use coating liquid:
Carbon black: 5 parts
Saturated polyester resin (B): 12 parts
Polyethylene wax: 3 parts
Methyl Ethyl Ketone (MEK): 80 parts The above-described reference sign (B) represents resin having terephthalic acid, isophthalic acid, and trimellitic acid as acidic components, and ethylene glycol and neopenthyl glycol as alcohol components. Further, number average molecular weight of the resin is 950, and its Tg is about 20 degree centigrade.

Sixth Example is now Described.

A releasing layer and a backside layer are formed in the same manner as the first example. A releasing layer use coating liquid having the below described composition is coated overlying the opposite side surface in the same manner as the fifth example, and is dried for 10 seconds at temperature of about 80 degree centigrade to obtain a releasing layer having about 1.5 g/m$^2$ on a dry basis. An ink layer use coating liquid having the below described composition is coated overlying the releasing layer in the same manner as the first example.

Composition of ink layer use coating liquid:
Carbon black: 5 parts
Saturated polyester resin (B): 12 parts
Polyethylene wax: 3 parts
Methyl Ethyl Ketone (MEK): 80 parts The above-described reference sign (B) represents resin having terephthalic acid, isophthalic acid, and trimellitic acid as acidic components, and ethylene glycol and neopenthyl glycol as alcohol components. Further, number average molecular weight of the resin is 950, and its Tg is about 20 degree centigrade.

First Comparative Example is now Described.

A releasing layer is formed on a substrate (e.g. a polyester film) in the same manner as the first example. An ink layer use coating liquid having the below described composition is coated overlying the releasing layer, and is dried for 10 seconds at temperature of about 60 degree centigrade to prepare an ink layer having about 1.5 g/m$^2$ on a dry basis. A backside layer is formed in the same manner as the first example. Thus, a thermal-transfer recording medium according to the present invention is made.

Composition of ink layer use coating liquid:

Carbon black: 5 parts

Saturated polyester resin (C): 15 parts

Methyl Ethyl Ketone (MEK): 80 parts

The above-described reference sign (C) represents resin having terephthalic acid, isophthalic acid as acidic components, and ethylene glycol and neopenthyl glycol as alcohol components. Further, number average molecular weight of the resin is 600, and its Tg is about 11 degree centigrade.

Second Comparative Example is now Described.

A releasing layer is formed on a substrate (e.g. a polyester film) in the same manner as the first example. An ink layer use coating liquid having the below described composition is coated overlying the releasing layer, and is dried for 10 seconds at temperature of about 70 degree centigrade to prepare an ink layer having about 1.5 g/m$^2$ on a dry basis. A backside layer is formed in the same manner as the first example. Thus, a thermal-transfer recording medium according to one embodiment of the present invention is produced.

Composition of ink layer use coating liquid:

Carbon black: 5 parts

Saturated polyester resin (D): 15 parts

Methyl Ethyl Ketone (MEK): 80 parts

The above-described reference sign (D) represents plate having terephthalic acid, isophthalic acid, and trimellitic acid as acidic components, and ethylene glycol and neopenthyl glycol as alcohol components. Further, number average molecular weight of the resin is 2000, and its Tg is about 37 degree centigrade.

A six point character (a numeral, alphabet, or Chinese character of a block letter type having a size of about 2.1 mm) is printed onto a white polyester film (e.g. one of LVIP manufactured by LINTEC Co, Ltd) as a transferring objective at the minimum printing energy scale, which is capable of writing one-dot horizontal line without a faint image, from each of the first to sixth examples and the first to second comparative examples. The printing is executed by a thermal-transfer printer (e.g. a line type thin film thermal head of I-4308 manufactured by DATAMAX Co. Ltd at printing speed of 101.6 mm/sec with dot density of 12 lines/mm). An energy scale used in a printing test is evaluated such that heat sensitivity is excellent as a printing energy scale becomes smaller. Further, reproducibility of a transferred character and a horizontal line is also evaluated. Further, by counting and evaluating a number of times of scratching an image using a tip of mechanical pencil until the image is cut away, rigidity of the image is determined as illustrated on a table of FIG. 1.

Table 1

As understood from the table, a horizontal line can be printed when heat sensitivity scale ranges from plus 8 to plus 10 in the first and second examples. Rigidity of an image is more improved in the third to sixth examples. It can be realized that the fifth example enables less energy printing with less heat sensitivity.

A method of executing evaluation test is as follows. A density scale of a thermal-transfer printer manufactured by DATAMAX Co., Ltd. is indicated as a heat sensitivity scale from minus 30 as the minimum to plus 30 as the maximum as a measure of the minimum printing energy that enables normal reproducing of the one dot horizontal line without a faint image.

An image reproducibility is determined as excellent, i.e., a circle is given, when a block letter type Chinese letter having six points is precisely printed without a faint image, while a cross is given when an image is unreadable. Image reproducibility is determined as excellent, i.e., a circle is given, when a block letter type numeral "1" having six points is precisely printed without a faint image, while a cross is given when an image has a faint image and is unreadable. Width of the horizontal line having one dot is measured using a microscope, and the horizontal line is evaluated as excellent, i.e., a circle is given, when it is precisely reproduced (e.g. one dot: about 0.008 mm) without becoming thick, while a cross is given when an image partially or entirely becomes thick.

Abrasion proof is measured as follows:

A number of times of reciprocally scraping an image with a metal tip of a mechanical pencil at the angle of 45 degree with a lead being sitting back by weight of 40 grams are counted until the image is cut away.

Numerous additional modifications and variations of the present invention are possible in light of the above teachings. It is therefore to be understood that within the scope of the appended claims, the present invention may be practiced otherwise that as specifically described herein.

What is claimed is:

1. A thermal transfer recording medium, comprising:

a substrate;

a releasing layer overlying the substrate, said releasing layer mainly comprising a wax; and an ink layer overlying the releasing layer, said ink layer comprising a coloring agent and a saturated polyester resin;

wherein said saturated polyester resin includes at least a tribasic acid component, a number average molecular weight of said saturated polyester resin ranges from about 300 to 1000, and the glass transition point of said saturated polyester resin ranges from about 10 to 50 degrees centigrade.

2. The thermal-transfer recording medium according to claim 1, wherein said ink layer further comprises a lubricant.

3. The thermal-transfer recording medium according to claim 2, wherein said lubricant is at least one selected from the group consisting of a polyolefin wax and an oxidized polyolefin wax.

4. The thermal transfer recording medium according to claim 1, wherein said releasing layer comprises a polyolefin wax.

5. The thermal transfer recording medium according to claim 1, wherein the wax of said releasing layer is at least one selected from the group consisting of bees wax, whale wax, Japan wax, rice wax, carnuba wax, candelilla wax, montan wax, shellac wax, paraffin wax, microcrystalline wax, ester wax, polyethylene wax, oxidized paraffin wax, oxidized polyethylene wax, ozokerite ceresin and alpha-olefin derivative.

6. The thermal-transfer recording medium according to claim 1, wherein the releasing layer further comprises a low viscosity performance-promoting agent, wherein the low viscosity performance-promoting agent is a resin selected from the group consisting of ethylene-vinyl acetate copolymer and ethylene-ethyl acrylate copolymer

7. The thermal-transfer recording medium according to claim 1, wherein the releasing layer further comprises at least one selected from the group consisting of butadiene rubber, ethylene-propylene rubber, butyl rubber, nitrile rubber and styrene-butadiene rubber.

8. The thermal-transfer recording medium according to claim 1, wherein the at least tri-basic acid componant is at least one selected from the group consisting of trimellitic acid and pyromellitic acid.

9. A method for forming a transfer image, comprising:

imagewise heating a thermal transfer recording medium as claimed in claim 1, with a line thermal head of a printer; and transferring an image formed on the thermal transfer recording medium onto a transferring objective.

10. The method according to claim 9, wherein said line thermal head is an end face head.

11. The method according to claim 9, wherein said transferring objective comprises at least one selected from a film and a paper.

* * * * *